United States Patent [19]

Weber et al.

[11] 3,945,494

[45] Mar. 23, 1976

[54] CARRIER FOR FILM CARTRIDGES OR THE LIKE

[75] Inventors: Klaus Weber, Munich; August Hell, Deisenhofen, both of Germany

[73] Assignee: AGFA-Gevaert AG, Leverkusen, Germany

[22] Filed: Dec. 5, 1973

[21] Appl. No.: 422,028

[30] Foreign Application Priority Data

Dec. 7, 1972 Germany ..... 2259934

[52] U.S. Cl. ..... 206/389; 206/459; 206/486

[51] Int. Cl.[2] ..... B65D 73/00; B65D 85/67

[58] Field of Search ..... 206/486, 389, 459, 461, 206/471; 229/70, 71; 242/71.2

[56] References Cited

UNITED STATES PATENTS

| | | | |
|---|---|---|---|
| 1,177,886 | 4/1916 | Newcomb | 229/70 |
| 2,226,943 | 12/1940 | Poppe | 229/70 |
| 2,845,758 | 8/1958 | Lowthian | 206/486 |
| 2,876,899 | 3/1959 | Maynard, Jr. | 206/471 |
| 3,278,015 | 10/1966 | Berstein | 229/71 |
| 3,358,824 | 12/1967 | Stagnitto | 206/461 |
| 3,407,781 | 10/1968 | Ardire et al. | 206/459 |
| 3,482,681 | 12/1969 | Herwin et al. | 242/71.2 |
| 3,593,635 | 7/1971 | Servetnick | 242/71.2 |

*Primary Examiner*—William T. Dixson, Jr.
*Attorney, Agent, or Firm*—Michael J. Striker

[57] ABSTRACT

A panel consisting of elastic cardboard, synthetic plastic material or a combination of both has one or more openings for reception of selected portions of cartridges for exposed but undeveloped photographic film and elastic lugs or tongues which hold the cartridge in its opening or openings or bias one or more projections of the cartridge against the panel. The cartridge is attached to the panel by a dealer who receives it from a customer and forwards the panel with the cartridge to a developing laboratory. A first section of the panel with a serial number and date of receipt is broken off the major portion of the panel and handed to the customer as a receipt. Another section of the panel which is provided with the same serial number as the first section and with the name of the customer is broken off and held by the dealer. The main portion of the panel is provided with encoded and/or unencoded information including the serial number, the dealer identification number and/or other data. The panel is used as a simpler and less expensive substitute for presently employed envelopes wherein the dealers mail or ship cartridges to the developing laboratory.

18 Claims, 7 Drawing Figures

Fig. 2a
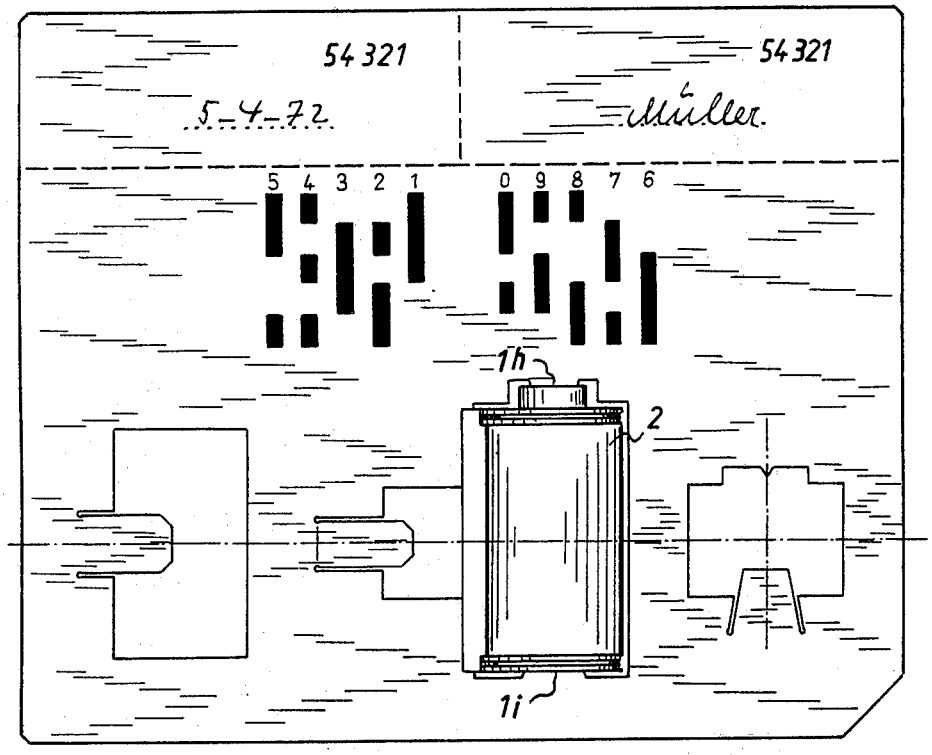
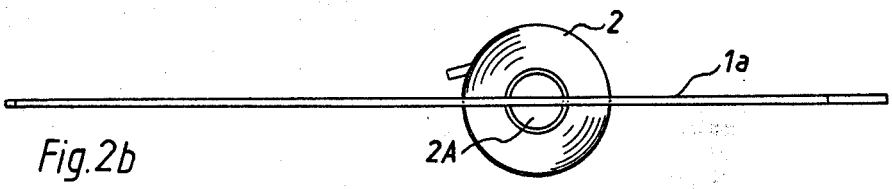
Fig. 2b

Fig. 3a
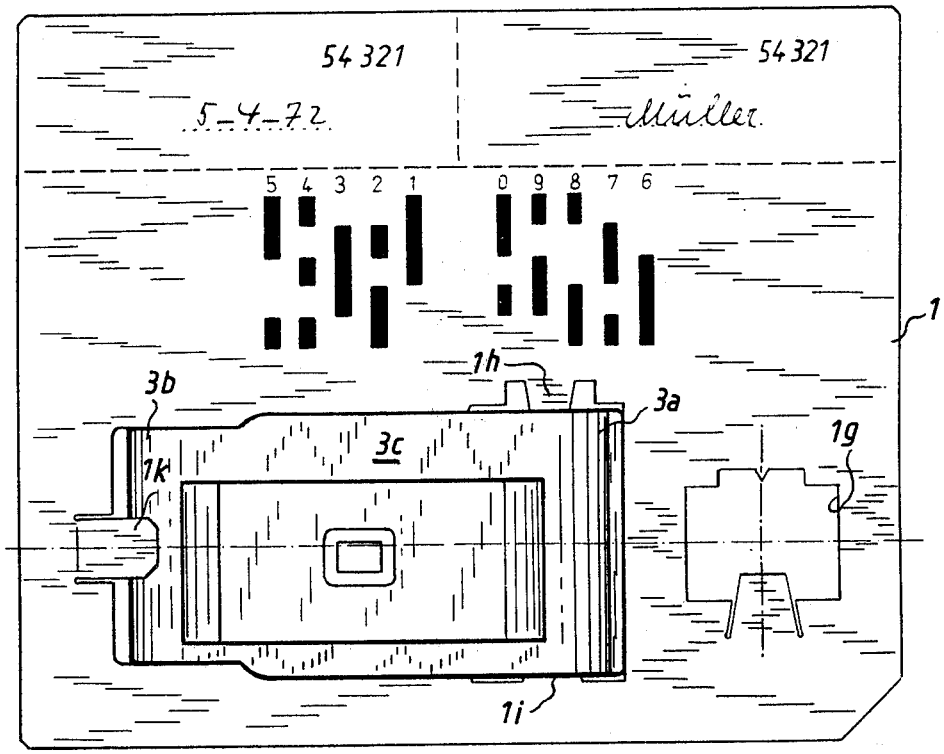
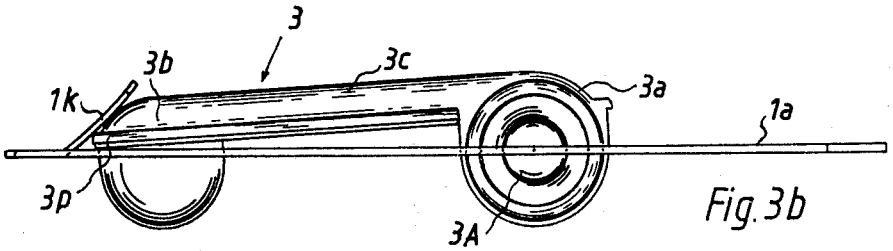
Fig. 3b

Fig.4a
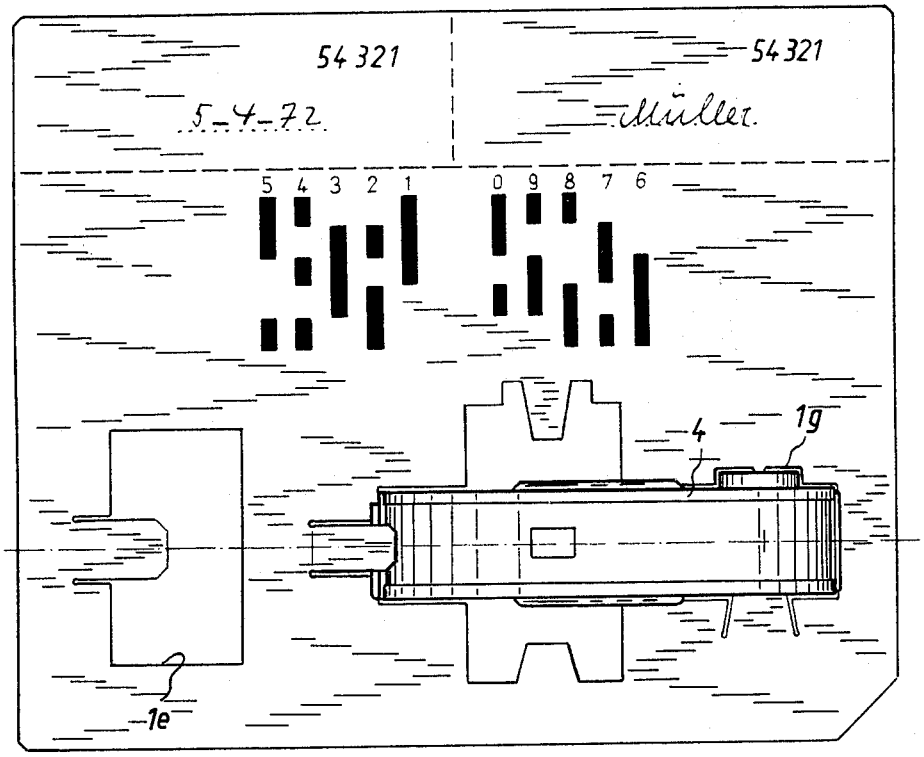
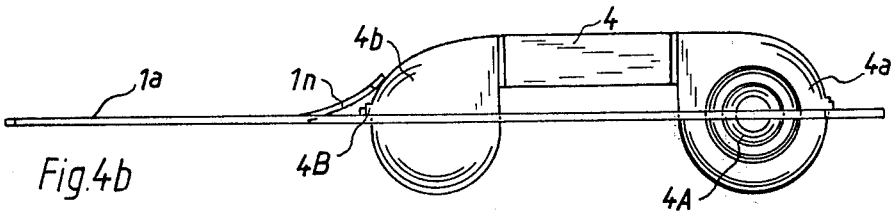
Fig.4b

CARRIER FOR FILM CARTRIDGES OR THE LIKE

BACKGROUND OF THE INVENTION

The present invention relates to devices for facilitating transportation, storage, identification and/or other manipulation of cartridges, magazines, cassettes and/or analogous receptacles for photographic film, especially receptacles for exposed but undeveloped photographic roll film.

When a customer delivers or mails a receptacle with exposed photographic film to a dealer in photographic materials or another agency which accepts films for shipment or delivery to a developing laboratory, the receptacle is normally placed into an envelope a portion of which is detached and handed to the customer as a receipt. The receipt is provided with a serial number a duplicate of which appears on the major portion of the envelope and the dealer often inscribes the date of anticipated completion of the order. The envelope is shipped to the processing laboratory where the film is developed and prints made therefrom, whereupon the envelope with the prints and/or developed film therein is returned to the dealer for shipment to or for pickup by the customer. The envelope is further provided with an encoded dealer identification number so that the laboratory can return the completed order to the proper party, and such envelope may be provided with a second detachable portion which is kept by the dealer to serve as a receipt and as a means for facilitating the identification of an order which is not returned to the dealer in time.

A drawback of the just described envelopes is that their manipulation necessitates a large amount of manual labor which contributes to the cost of development and print making. For example, a peson at the laboratory must manually remove a receptacle from the envelope in order to determine the nature of the receptacle and the type of film therein. Moreover, an envelope often contains two or more receptacles for exposed film which is highly undesirable, especially when the envelopes are processed automatically or semi-automatically. The situation is aggravated if the dealer inserts two or more difficult receptacles into the same envelope.

SUMMARY OF THE INVENTION

An object of the invention is to provide a novel and improved device which can support and hold receptacles for photographic film during storage in a photo shop, during transport or shipment to a developing laboratory, during shipment or delivery back to the shop, and/or during storage in the shop prior to handing of the completed order to the customer.

Another object of the invention is to provide a novel and improved carrier for receptacles containing photographic film which is simpler, more compact, more versatile and less expensive than heretofore known carriers.

A further object of the invention is to provide a carrier which permits at all times the determination of the nature of receptacle which is being supported thereby and/or for determination of the type of film in such receptacle.

An additional object of the invention is to provide a carrier which is designed to allow for achievement of substantial savings in time and labor cost during utilization as a means for supporting and holding receptacles for photographic roll film.

Still another object of the invention is to provide a versatile carrier which can support any one of two or more different types of receptacles for photographic film.

A further object of the invention is to provide a carrier which is designed in such a way that it does not permit for proper attachment of more than one receptacle at a time and to or from which a receptacle may be attached or detached in a simple way, without the exertion of a substantial effort but that the receptacle is properly held until and unless its detachment from the holder is desired or necessary.

The invention is embodied in a carrier for receptacles containing photographic film, especially exposed but undeveloped photographic roll film. The carrier constitutes a substantially flat panel which may but need not have a rectangular outline and may consist entirely or in part of an elastic material, such as cardboard, one or both sides of which are coated with a synthetic plastic substance or a synthetic plastic material. The panel has two surfaces at least one of which is provided with encoded and/or unencoded information which may include a serial number, a dealer identification number, data indicating the number of prints to be made, the size of prints, the quality and nature of prints, special instructions regarding the development of film and/or others. The panel is further formed with at least one opening for reception of a portion of a receptacle and elastic detent means for yieldably holding such portion of the receptacle in the opening. The outline of the opening preferably matches or closely resembles the outline of that predetermined portion of a receptacle which is to be received in the opening when the detent means properly engages and holds the receptacles on the panel.

The detent means may comprise one or more projections in the form of lugs or tongues which preferably bound a portion of the opening and may be flanked by notches, slits or analogous recesses which communicate with the opening and enhance the flexibility of the respective projections. Such projections may enter sockets which are provided in a receptacle for exposed film or they may serve to bias one or more projections of a receptacle against one side of the panel.

If the panel has two or more openings, they are preferably distributed in such a way that the panel cannot properly hold a second receptacle once a first receptacle has been properly secured thereto. The configuration of the opening or openings and/or detent means is such that the panel can support different types of receptacles but preferably only one receptacle at a time. A receptacle can extend into a single opening or it may extend simultaneously into a plurality of openings.

The novel features which are considered as characteristic of the invention are set forth in particular in the appended claims. The improved carrier itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2*a* is a similar view of the carrier and further showing a first receptacle for exposed photographic film which is separably connected to and held by the carrier;

FIG. 2*b* is an end elevational view of the structure shown in FIG. 2*a;*

FIG. 3*a* is a side elevational view of the carrier and further showing a second receptacle which is separably connected to and held by the carrier;

FIG. 3*b* is an end elevational view of the structure shown in FIG. 3*a;*

FIG. 4*a* is a side elevational view of the carrier and further showing a third receptacle which is separably connected to and held by the carrier; and FIG. 4*b* is an end elevational view of the structure shown in FIG. 4*a*.

DESCRIPTION OF THE PREFERRED EMBODIMENTS

Figure 1:
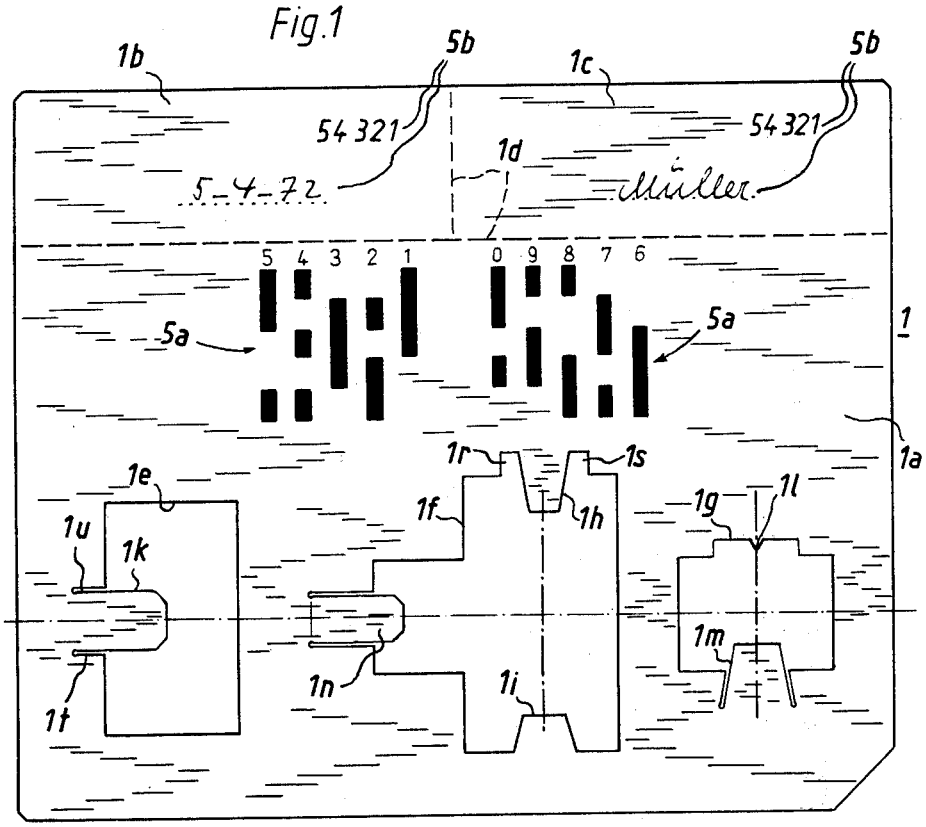
FIG. 1 is a side-elevational view of a carrier which embodies the invention.

FIG. 1 is a side elevational view of a carrier which embodies the invention. The carrier constitutes a substantially flat panel 1 which may but need not have a rectangular outline and may consist entirely or in part of an elastic material such as cardboard, one or both sides of which are coated with a synthetic plastic substance, or a synthetic plastic material. The panel has two surfaces, at least one of which is provided with encoded information 5*a* and/or unencoded information 5*b* which may include a serial number (54321), a dealer identification number (09876), data indicating the number of prints to be made, the size of prints, the quality and nature of prints, special instructions regarding the development of film and/or others.

The panel is further formed with three differently configurated openings 1*e*, 1*f*, 1*g* for reception of one or more portions of a receptacle (not shown), and with elastic detent means 1*h*, 1*i*, 1*k*, 1*l*, 1*m*, 1*n* for yieldably holding such portion or portions of the receptacle in the opening or openings. The carrier 1 further comprises two rows of perforations 1*d* which weaken the panel between the sections 1*b*, 1*c* and 1*a* of the carrier 1. The sections 1*b* and 1*c* contain spaces where customer number, name, date of anticipated completion of the order or other information may be imprinted or written. The section 1*a* is the main section of the panel 1 and the openings 1*e*–1*g* and detent means 1*h*–1*n* are provided to this main section. The section 1*b* is intended to constitute a receipt for the customer, and the section 1*c* is intended to constitute a receipt for the dealer.

The rows of perforations 1*d* may be replaced by scoring lines or other means for weakening or reducing the thickness of the panel 1 between the sections 1*a*, 1*b* and 1*c* so that the dealer can readily separate the section 1*b* from the sections 1*a*, 1*c* and hand it to a customer, and the section 1*c* from the section 1*a* so as to keep the section 1*c* in his shop. Prior or after separation of the section 1*b* from sections 1*a*, 1*c*, the dealer inscribes the anticipated date of completion of the order (May 4, 1972 in FIG. 1) on the section 1*b*. At the same time, the dealer can inscribe the name and address and/or account number of the customer on the section 1*c*.

The left-hand encoded number 5*a* on the main section 1*a* of the panel is identical with the unencoded serial numbers (54321) on the sections 1*b* and 1*c*. The right-hand encoded number (09876) on the main section 1*a* is a dealer identification number.

The outline of the centrally located opening 1*f* in the main section 1*a* of the panel 1 corresponds to the outline of a predetermined portion of a receptacle 2 shown in FIGS. 2*a* and 2*b*. This receptacle is a substantially cylindrical cartridge of the type used in many still cameras for storage of 35-millimeter roll film. The receptacle 2 has customary sockets 2A at its ends and the detent means 1*h*, 1*i* which bound a portion of the opening 1*f* are designed to penetrate into the respective sockets 2A and to thereby yieldably hold the receptacle 2 in the position shown in FIGS. 2*a* and 2*b*. It will be noted that the detent means 1*h*, 1*i* extend into the respective sockets 2A when a predetermined portion of the receptacle 2 is received in the opening 1*f*, namely, a portion which includes the axis of the receptacle. When the panel 1 serves for retention of a receptacle 2, the openings 1*e* and 1*g* remain empty.

FIGS. 3*a* and 3*b* show that the opening 1*f* can further serve to receive a portion of the takeup section 3*a* of a receptacle 3 of the type known as a drop-in cartridge or cassette No. 126. A portion of the supply section 3*b* of the receptacle 3 extends into the opening 1*e* whereby the elastic detent means 1*k* biases a projection 3*p* of the receptacle 3 against the upper side of the main section 1*a*, as viewed in FIG. 3*b*. The detent means 1*h*, 1*i* extend into the respective sockets 3A of the section 3*a* so that the receptacle 3 is held at three spaced-apart points, namely, by the detent means 1*h*, 1*i* and 1*k*. The opening 1*g* remains empty. The elasticity of the detent means 1*h* is enhanced by the provision of two recesses or notches 1*r*, 1*s* (FIG. 1) which flank a portion of the detent means 1*h* and communicate with the opening 1*f*. Similar recesses 1*t*, 1*u* are provided adjacent to the detent means 1*k* which is a flexible tongue and urges the projection 3*p* against the main section 1*a* when the receptacle 3 is properly mounted on the panel 1. The configuration of the openings 1*f* and 1*e* is such that a portion of the supply section 3*b* of the receptacle 3 practically fills the opening 1*e* when the detent means 1*k* maintains the projection 3*p* in contact with the main section 1*a*, and that a portion of the takeup section 3*a* practically fills the opening 1*f* when the detent means 1*h*, 1*i* extend into the respective sockets 3A. The intermediate section 3*c* of the receptacle 3 has a customary window for admission of scene light against the foremost unexposed film frame, and such window faces the adjacent side of the main section 1*a* when the receptacle 3 is secured to the panel 1 in a manner as shown in FIGS. 3*a* and 3*b*.

FIGS. 4*a* and 4*b* illustrate a third receptacle 4 which is known as cassette No. 110 and is somewhat similar to the receptacle 3 of FIGS. 3*a* and 3*b*. The takeup section 4*a* of the receptacle 4 is received in the opening 1*g* and the supply section 4*b* is received in the opening 1*f*. The elastic detent means or tongue 1*n* performs the same function as the detent means 1*k* of FIGS. 3*a* and 3*b*, i.e., the detent means 1*n* biases a projection 4B of the supply section 4*b* against the adjacent side of the main section 1*a*. The section 4*a* of the receptacle 4 has sockets 4A which receive portions of the detent means 1*l* and 1*m* to thus insure that the opening 1*g* receives that portion of the takeup section 4*a* which practically completely fills the opening 1*g*. The detent means 1*l* is a pointed projection of substantially triangular outline. It will be noted that the receptacle 4 need not completely fill the opening 1*f* even when the projection 4B abuts against the main section 1*a* of the panel 1.

The panel 1 may be made of cardboard which should exhibit sufficient elasticity to allow for necessary flexing of certain detent means in order to insure satisfactory attachment of a receptacle 2, 3 or 4 to the main section 1*a*. Also, the panel 1 may comprise a layer of cardboard one or both sides of which are coated with one or more layers of a synthetic plastic material. For example, the thickness of a cardboard panel which is coated with one or more layers of synthetic plastic material may be in the range of 1 millimeter. Furthermore, the panel 1 may be made entirely of an elastic synthetic plastic material having a thickness of less than 1 millimeter, for example, one half millimeter. The nature of synthetic plastic material should be such that it can be readily imprinted to receive and retain encoded and/or unencoded information. Regardless of the nature of the material of the panel, a certain amount of elasticity is always desirable in order to avoid breakage or permanent deformation of detent means during attachment of a receptacle 2, 3 or 4 to the main section 1*a*.

The distribution of openings 1*e*, 1*f*, 1*g* in the main section 1*a* of the panel 1 is such that only one receptacle can be attached and held at a time. Thus, if the receptacle 2 occupies the centrally located opening 1*f*, the panel 1 cannot properly support a receptacle 3 or 4. Analogously, when the panel 1 supports a receptacle 3 or 4, it cannot support a receptacle 2. This will be readily appreciated by considering that the receptacle 2 is insertable into the centrally located opening 1*f* whereas the receptacle 3 or 4 respectively occupies the openings 1*e*, 1*f* or 1*f* 1*g*.

The improved carrier is utilized as follows:

The processing laboratory sends or delivers to a dealer a supply of panels 1 each of which has a different serial number on each of the sections 1*a*–1*c* and an identical dealer identification number on the main section 1*a*. The serial numbers on the sections 1*b*, 1*c* are unencoded and the serial number on the main section 1*a* is encoded. The dealer identification number is also encoded so that the information which is applied to the main section 1*a* can be read by an automatic reader.

If a customer brings to the dealer a receptacle 2, 3 or 4 with exposed but undeveloped film (e.g., to a shop specializing in the sale of photographic equipment, to a drugstore, to a cigar stroe or to a department store), the dealer or his employee attaches the receptacle to the main section 1*a* in a manner as shown in FIGS. 2*a*–2*b*, 3*a*–3*b* or 4*a*–4*b*, depending on the type of receptacle. This involves some flexing of one or more elastic detent means. The person in charge further writes the date of anticipated completion of the order onto the section 1*b* and the name of the customer onto the section 1*c*. Once the receptacle is properly attached to the main section 1*a*, it remains in such position until it reaches the processing laboratory. The person in charge detaches the section 1*b* and hands it to the customer, and the person also detaches the section 1*c* and retains it in the film so as to allow for convenient identification of the corresponding main section 1*a* and the receptacle if the order is not returned to the dealer in good time before the customer calls for the developed film and/or prints.

When the section 1*a* (with the receptacle 2, 3 or 4 attached thereto) reaches the processing laboratory, the receptacle is detached, either by hand or automatically, and the film in the receptacle and/or the receptacle itself is provided with identifying data so as to insure that the section 1*a* can be assembled with developed film and prints when the development and making of prints in the laboratory are completed. This can be achieved by imprinting or otherwise applying an identification number or symbol on the film, on the receptacle and/or on the respective main section 1*a*, or by processing the films which are withdrawn from successive receptacles in the same sequence in which the main sections 1*a* are stored in the laboratory.

For billing of the customer upon completion of the order, the dealer relies on the section 1*c* for determining the name of the customer (and eventually the address of the customer if the developed film and the prints are to be shipped to the customer rather than picked up at the dealer's shop). The processing laboratory uses the information on the main section 1*a* for the preparation of an invoice to the dealer or for charging the dealer's account if the payments to the laboratory are to be made on a monthly or quarterly basis. To this end, the laboratory normally resorts to an automatic reader which supplies data to an automatic invoice writer or to an automatic apparatus which charges the account of the dealer.

The invoice to the dealer preferably includes the serial number in unencoded form so that the dealer can properly file the invoices to thus insure that the invoice can be found without delay when the customer calls for the completed order.

The purpose of the main section 1*a* is fulfilled with completion of the invoice to the dealer or with completion of the charging of the dealer's account, i.e., the section 1*a* can be discarded in the laboratory. However, it is equally possible to enclose the section 1*a* with the shipment to the dealer.

It is equally within the purview of the invention to provide each carrier with a single opening or with such number of openings that the carrier can separably support a single type of receptacles. For example, the carrier of FIG. 1 can be replaced with three carriers one of which has only one opening 1*f*, another of which has openings 1*e*, 1*f* and a third of which has openings 1*f*, 1*g*. In such instance, the laboratory will provide the dealer with requisite supplies of three different carriers.

An advantage of the improved carrier is that manual sorting of carriers according to the types of films takes up much less time than the sorting of conventional envelopes and that the carriers can be sorted automatically without necessitating a separation of receptacles.

Without further analysis the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is:

1. A combination of a carrier and receptacles of different configurations containing photographic films, especially exposed but undeveloped photographic roll films, said carrier constituting a substantially flat panel having two surfaces at least one being provided with encoded and/or unencoded information, said panel having a plurality of openings of different configurations corresponding to said different configurations of said receptacles, and elastic detent means, at least one in each opening, a portion of either one of at least two receptacles of different configurations being received in at least one of said openings with said portion extending into said opening engaged by the respective detent means and preventing the attachment of additional receptacles to said panel.

2. A combination as defined in claim 1, wherein the outlines of said openings substantially conform, respectively, to the outlines of portions of said receptacles for photographic film.

3. A combination as defined in claim 1, wherein said information includes data pertaining to the customer and/or dealer and a serial number.

4. A combination as defined in claim 1, wherein said detent means comprises one tongue for each of said openings arranged to be flexed out of the plane on one of said openings and to engage a second portion of one of said receptacles another portion of which extends into another of said openings.

5. A combination as defined in claim 4, wherein said projections are located in the plane of said one opening, at least when said one opening is unoccupied.

6. A combination as defined in claim 4, wherein said one of said receptacles is of the type having a projection which abuts against one side of said panel under the action of said tongue while said other portion of said one receptacle extends into said other opening.

7. A combination as defined in claim 1, wherein said detent means comprises at least one elastic projection bounding a portion of one of said openings, said panel having recesses communicating with said one opening and flanking a portion of said projection to thereby enhance the flexibility of said projection.

8. A combination as defined in claim 1, wherein said detent means for one of said openings includes a pair of flat projections bounding said one opening and wherein a portion of one of said receptacles having a pair of sockets extends into said one opening, said projections respectively extending into said sockets of said one receptacle.

9. A carrier as defined in claim 8, wherein said detent means for another of said openings comprises at least one tongue arranged to be flexed out of the plane of said other opening and to engage a second portion of a receptacle another portion of which extends into said other of said openings.

10. A combination as defined in claim 1, wherein said panel includes a first section which is provided with said openings and comprises said detent means, and at least one additional section, said panel further having a weakened portion extending between said sections to facilitate the breakage of said panel between said sections.

11. A combination as defined in claim 10, wherein said panel comprises several additional sections.

12. A combination as defined in claim 11, wherein said information includes an unencoded customer number applied to each of said additional sections.

13. A combination as defined in claim 10, wherein said weakened portion has a row of perforations.

14. A combination as defined in claim 10, wherein the thickness of said weakened portion is less than the thickness of the major part of said panel.

15. A combination as defined in claim 1, wherein the entire panel consists of elastic material.

16. A combination as defined in claim 15, wherein said panel consists of cardboard.

17. A combination as defined in claim 15, wherein said panel consists of synthetic plastic material.

18. A combination as defined in claim 16, wherein said panel includes a first layer consisting of cardboard and at least one layer of synthetic plastic material applied to one side of said first layer.

* * * * *